US006017398A

United States Patent [19]

Scotto et al.

[11] Patent Number: 6,017,398

[45] Date of Patent: Jan. 25, 2000

[54] IMMERSED METAL CLEANING BY SUBJECTING OBJECT TO NATURAL RESONANT FREQUENCY

[75] Inventors: Alain Scotto, Massongy; Jean Louis Janin, Fillinges, both of France

[73] Assignee: Forward Technology Industries, Annemasse, France

[21] Appl. No.: 09/066,939

[22] Filed: Apr. 28, 1998

[51] Int. Cl.[7] ..... B08B 3/12

[52] U.S. Cl. ..... 134/1; 134/10; 134/186

[58] Field of Search ..... 134/1, 10, 184, 134/186

[56] References Cited

U.S. PATENT DOCUMENTS

| | | | |
|---|---|---|---|
| 2,958,332 | 11/1960 | Schueler | 134/169 |
| 4,836,684 | 6/1989 | Javorik et al. | 366/114 |
| 4,940,494 | 7/1990 | Petit et al. | 134/1 |
| 5,076,854 | 12/1991 | Honda et al. | 134/1 |
| 5,118,355 | 6/1992 | Browning | 134/1 |
| 5,119,840 | 6/1992 | Shibata | 134/184 |
| 5,143,103 | 9/1992 | Basso et al. | 134/98.1 |
| 5,617,887 | 4/1997 | Shibano | 134/184 |
| 5,711,327 | 1/1998 | Fields | 134/105 |
| 5,865,199 | 1/1999 | Pedziwiatr et al. | 134/1 |

*Primary Examiner*—Randy Gulakowski
*Assistant Examiner*—Saeed Chaudhry
*Attorney, Agent, or Firm*—Pollock, Vande Sande & Amernick

[57] ABSTRACT

A method of cleaning a metal part such as a casting, wherein the part to be treated is placed on a support plate inside a container full of fluid, and at least one vibration generator is positioned in contact with the part. Generators are used to excite one natural mode of vibration of the part, causing the fluid inside the part to cavitate. The vibration generators in contact with the part operate with a running cycle for the vibration sources which is optimized by managing the state of the sources.

14 Claims, 2 Drawing Sheets

IMMERSED METAL CLEANING BY SUBJECTING OBJECT TO NATURAL RESONANT FREQUENCY

FIELD OF THE INVENTION

The present invention relates to a cleaning method and to a device for implementing this method, this method making it possible to extract foreign bodies (dust, sand, residues of material, etc.) and dirt from inside hollow rigid chambers such as castings. The complex and sinuous shape of such bodies do not allow easy access to the regions to be cleaned. It is aimed more specifically at a method for cleaning metal parts intended advantageously for the to automotive or aeronautical industry, such as gearbox housings, cylinder heads, and pump housings.

SUMMARY OF THE PRIOR ART

Conventional methods of cleaning parts employ various techniques, such as low-frequency vibrations, the circulation of fluids at high pressures, the cavitation of a fluid in ultrasound tanks (the part having been placed in the tank beforehand), shot peening with steel balls or ice, or alternatively a manual method using a scraper or brush.

When solid metal parts based essentially on aluminium or aluminium alloys and which do not have a hardness similar to that of cast iron or steel are being cleaned, shot-peening techniques run the risk of damaging the part and further, the shot cannot reach the ends of small cross-section ducts, of which there are a great many in a cylinder head, for example.

It will be readily understood that manual techniques cannot be applied on an industrial scale to the mass-production of parts.

Given that these parts are castings, residues of sand, slag or possibly machining swarf remains inside the lubrication or cooling ducts and is extremely difficult to remove, even using low-frequency vibration techniques or using techniques of the cavitation of a fluid in an ultrasound tank, particularly when the fluid is no longer cavitating within the small ducts.

BRIEF SUMMARY OF THE INVENTION

The present invention aims therefore at alleviating these drawbacks by proposing an industrial method which offers excellent cleaning efficiency even within the little nooks and crannies of a solid casting.

For this, the cleaning method according to the invention is characterized in that:

the part to be treated is placed on a support plate inside a container full of fluid, at least one vibration generator is positioned in contact with the part, generators are used to excite one natural mode of vibration of the part, this causing the fluid inside the part to cavitate.

According to an advantageous feature, the device for implementing the method that is the subject of the invention it comprises a container positioned on a table secured to a bed of a machine, this container being provided with an elastic support on which the part to be treated rests, the whole assembly bathing in a fluid which may, as appropriate, be circulated by a pump connected to the container, the bed further supporting at least one vibration generator in contact with the said part and allowing at least one natural mode thereof to be excited.

Other features and advantages of the present invention will emerge from the description given hereinbelow, with reference to the appended drawings which illustrate one embodiment thereof which is devoid of any restrictive nature. In the figures:

DETAILED DESCRIPTION

According to a preferred embodiment of the method that is the subject of the invention, the part 7 to be treated is placed within a container 5 full of a cleaning fluid 8, for example a liquid, the fluid covering all or some of the part 7 in order to reduce the energy needed to vibrate it, while in particular bathing all the ducts and interstices thereof.

Figure 2:
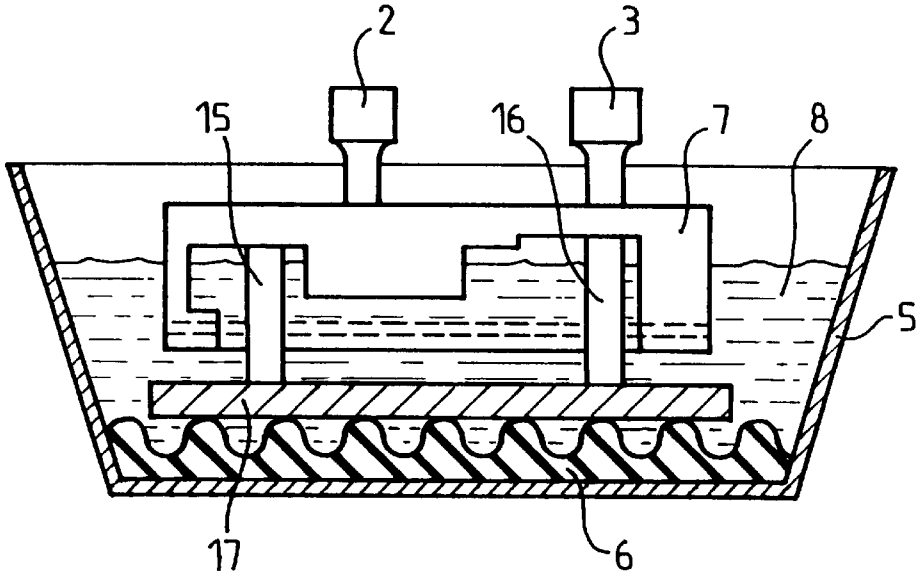
FIG. 2 is a sectional view illustrating another embodiment of a device for the implementation of the method that is the subject of the invention.

The container 5 rests on a table 4 secured to a bed 1 of a machine and comprises an elastic support 6 on which the part 7 to be cleaned rests. It is necessary for the support to be elastic enough to avoid reflections of excessive inertia onto the vibration generators 2, 3. Excessive flexibility of the support 6 would dampen resonance of the part 7. It is sometimes necessary, with a view to increasing the effectiveness of the incident wave, to create a reverberation by adding, between the part 7 and the elastic support 6, a reaction anvil (cf. FIG. 2) composed of a number of metal posts 15, 16 tuned to the incident frequency of the source or to a natural frequency of the part, it being possible that these posts may be connected together by a part 17 of Experimentally-determined mass.

Figure 1:
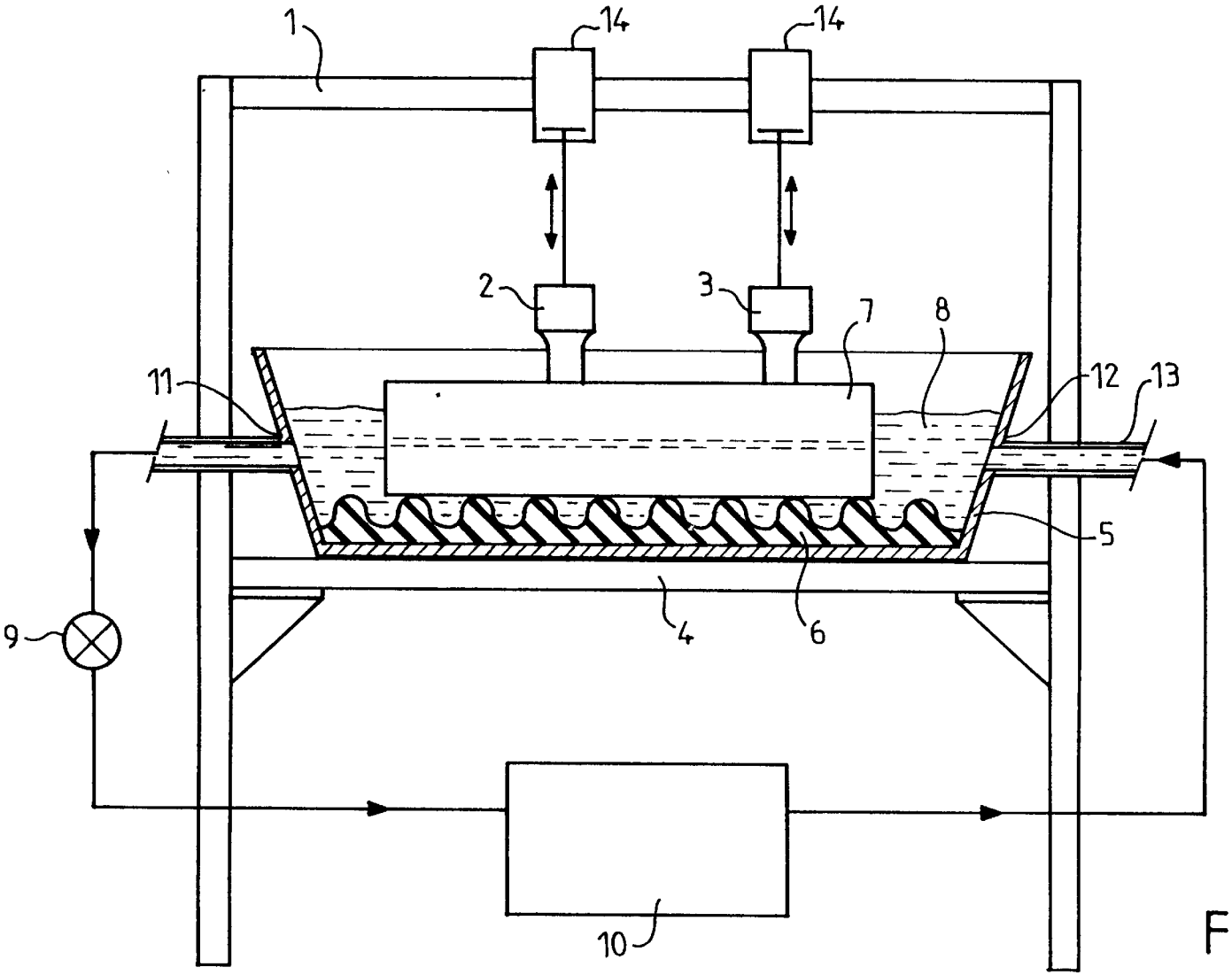
FIG. 1 illustrates a device allowing the implementation of the method which is the subject of the invention.
Figure 3:
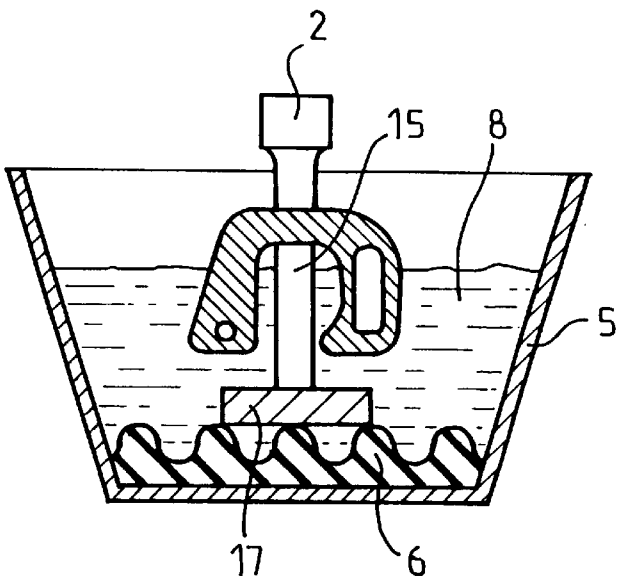
FIG. 3 is a sectional view illustrating the positioning of the part in its cleaning container.

The part 7 needs to be oriented in such a way that the ducts or cavities to be cleaned remain as free ends (cf. FIG. 3) with respect to the points of action of the sources (2, 3) or with respect to the points of reaction of the posts (15, 16).

Then, within the container 5, the part 7 resting on its elastic support 6 and bathed in the appropriate fluid 8 is brought into resonance using a number of vibration generators 2, 3.

According to another embodiment, the elastic support 6 is replaced by an actuator 14, the movements of which can be controlled.

Advantageously, these vibration generators 2, 3 are ultrasound heads, commonly called sonotrodes, the ultrasound being produced by a vibrating element moved by a piezoelectric system or by a magnetostrictive system.

The hammers or the vibration generators preferably work at a frequency of between 15 and 40 kHz.

These heads 2, 3 are borne by the bed 1 of the machine and converge with the aid of a number of actuators 14 produced from pneumatic, hydraulic, mechanical or electrical elements, such as rams or motors, towards the part 7 along axes which are not necessarily parallel.

The sonotrodes are brought into contact with the part 7 at experimentally determined points of action, so that by hammering they can set the part in a natural resonance mode. The mode of resonance of the part 7 is reached all the more quickly if the action of the vibration generators 2, 3 and the forces of contact under the pressure of the actuators secured to the generators are combined.

Bringing the part 7 into resonance gives rise to cavitation of the fluid 8 in which the part 7 is bathed, and more especially, the cavitation of fluid 8 also propagated to the inside of the small-section ducts and interstices present in the part.

The extremely intense turbulence of the fluid that exists in all of the little nooks and crannies of the part 7 causes these to be cleaned, the dirt and residue being carried along by the cavitating fluid.

The fluid in turbulence (it being possible for this fluid to be in the form of a liquid or gaseous fluid) during its cleaning phase, and which to begin with was not contaminated, gradually becomes laden with residue which will act as an abrasive body, correspondingly improving the effectiveness of the cleaning.

It is anticipated that use be made of a pump 9 fitted with an appropriate filter 10 in the fluid circuit, the container 5 accommodating the part 7 also being provided with an inlet orifice 11 and with an outlet 12 for this fluid, these being connected respectively to the ends of the pipe 13 which support the pump 9 and the filter 10.

In order to maintain maximum cleaning effectiveness, the pump 9 operates intermittently while the fluid 8 is being recycled so that this fluid maintains an optimum residue concentration, only a fraction of the dirt being stopped by the filter 10.

Depending on the type of dirt or residue to be removed, mechanical cleaning action under the effect of the cavitation of the fluid will if necessary be supplemented by a chemical action, it being possible for the fluid to consist fully or partially of a solvent or of a lye. In order to limit the incident energy needed, especially in the case of parts which have a very high mass, such as engine blocks, the volume of fluid may be restricted just to the ducts or cavities to be cleaned by trapping or by controlled circulation.

Furthermore, depending on the envisaged applications, it is sometimes necessary to use, not a conventional container 5 (which is not excited by generators 2, 3), but a tank 5' similar to the one used in ultrasound cleaning methods (in this case, the tank 5' is connected to an ultrasound generator which brings it into resonance). In this application, the two resonance modes, one originating from the tank 5', and the other from the part 7 combine within the circulating fluid 8 and this increases the intensity of the cavitation of the fluid and therefore the effectiveness of the cleaning.

As we saw earlier, the energy needed to bring the casting 7 into resonance or the need to increase transmission over a series of perfectly defined regions requires the use of a number of ultrasound generators (sonotrodes) which may either work simultaneously or work alternately following a cyclic protocol determined as a function of the result to be had on the part 7.

Furthermore, it is very often necessary for the coupling between the vibration sources 2, 3 and the part 7 to be brought into resonance to be optimized by adding a specific sinusoidal or discontinuous movement to each of the vibration generators.

In a first method, at least one of the vibration sources connected to the bed of the machine is decoupled using an elastic device which is adjustable, for example using a pre-loadable spring, so as to optimize the stiffness of the oscillating system.

In a second method, the modulation of the force applied to the part to be vibrated is controlled by feedback control of the contact pressure between the vibration source and the part by adjusting the force transmitted to this vibration source by the actuator 14.

In a third method, the intensity of the shocks applied to the part to be vibrated is controlled by using the speed or the acceleration for feedback control of the reciprocating movement of the vibrational source independently of the rate of is vibration of the working face of this source by means of the actuator 14.

In a fourth method, the vibrational frequency of the source is modulated by amplitude-modulation of the electrical signal supplied to the piezoelectric or magnotostrictive system under the effect of a periodic signal of lower frequency. In the case of a vibrating source which has a very wide passband, it is possible to frequency-modulate within the limits of this band.

These four non-limiting methods which may, if necessary, be combined with each other are intended, on the one hand, to avoid a standing state where all the energy supplied would be reflected rather than absorbed by the casting to be brought into resonance, and on the other hand to optimize a contact frequency of the vibrating source (sonotrode) onto one or more natural mode(s) of vibration of this part.

Obviously, the present invention is not restricted to the embodiments described and depicted hereinabove but encompasses all alternative forms thereof. Particularly, for cleaning parts of large volumes, such as engine blocks and taking into account the sometimes limited vibratory power, it may be necessary to use a gas as such fluid in order that said parts may be submitted to vibrations.

It is necessary that this fluid be able to remove the free residues of materials which are separated from the said vibrating parts, particularly by pressure injection means or by suction devices.

This fluid must flow through a filtration device in order to collect said residues.

Of course, said gas flow may be only restricted to a cavity or to a conduct to be cleaned.

We claim:

1. A method for cleaning a metal object comprising the steps:

providing a container filled with fluid;

including a support plate in the fluid;

placing the object to be treated on the support plate;

positioning at least one vibration generator in direct contact with the object;

activating the generator to vibrate at a preselected frequency thereby inducing a natural harmonic vibration of the object;

causing fluid inside the object to cavitate in response to the induced vibration of the object; and subjecting the vibration generator to a preselected movement during an operational cycle for optimizing coupling between the generator and the object.

2. A method for cleaning a metal object as set forth in claim 1 wherein the fluid is a liquid.

3. A method for cleaning a metal object as set forth in claim 1 wherein the fluid is a gas.

4. A method for cleaning a metal object as set forth in claim 1 wherein the vibration generator operates in a frequency range of 15 to 40 kHz.

5. A method for cleaning a metal object as set forth in claim 1 wherein the container in which the object rests is brought to resonance.

6. A method for cleaning a metal object as set forth in claim 1 wherein a plurality of activated vibration generators vibrate simultaneously.

7. A method for cleaning a metal object as set forth in claim 1 wherein a plurality of activated vibration generators vibrate alternately.

8. A method for cleaning a metal object as set forth in claim 1 together with the step of varying the pressure between the generator and the object through an intermediate elastic member that creates an oscillating system of optimized stiffness.

9. A method for cleaning a metal object as set forth in claim 1 together with the step of subjecting the object to varying pressure by the vibration generator, in response to a feedback control system between the object and the generator.

10. A method for cleaning a metal object as set forth in claim 1 together with the step of controlling the intensity of vibration.

11. A method for cleaning a metal object as set forth in claim 1 together with the step of modulating the vibrational frequency of the generator vibrations by energizing the vibrational generator with an amplitude modulated driving signal.

12. A method for cleaning a metal object as set forth in claim 1 together with the step of modulating the vibrational frequency of the generator vibrations by energizing the vibrational generator with a frequency modulated driving signal.

13. A method for cleaning a metal object as set forth in claim 1 wherein the object includes cavities therein; and further wherein the ends of the object cavities remain free of contact by the vibration generator.

14. A method for cleaning a metal object as set forth in claim 1 wherein the object includes cavities therein, the method including the step of restricting cavitating fluid to the cavities by controlling the circulation of fluid therein.

* * * * *